United States Patent [19]

Kantz et al.

[11] 4,030,297

[45] June 21, 1977

[54] HYDROGEN COMPRESSION SYSTEM FOR STIRLING ENGINE POWER CONTROL

[75] Inventors: Don B. Kantz, Ferndale; Tim F. Lezotte, Dearborn, both of Mich.

[73] Assignee: Ford Motor Company, Dearborn, Mich.

[22] Filed: June 28, 1976

[21] Appl. No.: 700,678

[52] U.S. Cl. ..... 60/521; 60/522; 60/525

[51] Int. Cl.[2] ..... F02G 1/06

[58] Field of Search ..... 60/517, 521, 522, 525, 60/526

[56] References Cited

UNITED STATES PATENTS

| | | | |
|---|---|---|---|
| 2,616,243 | 11/1952 | Van Weenen | 60/521 |
| 3,699,770 | 10/1972 | Bennethum | 60/525 X |
| 3,914,940 | 10/1975 | Bergman | 60/521 |

*Primary Examiner*—Allen M. Ostrager
*Assistant Examiner*—Stephen F. Husar
*Attorney, Agent, or Firm*—Joseph W. Malleck; Keith L. Zerschling

[57] ABSTRACT

A closed working fluid system for a regenerative Stirling engine is disclosed. The system employs double-acting pistons arranged with each low temperature (compression) space connected to one hot (expansion) space of an adjacent piston. The low temperature spaces are all connected to a reservoir system employing two separate chambers, one at a high pressure and another at a relatively low pressure. Control means select the reservoir for communication with the working system depending on the torque demand of the engine; the control means also permits fluid flow to pass from any one low temperature space to the selected reservoir when the pressure condition in the low temperature space exceeds the associated reservoir pressure. Independent communication is provided between each pair of adjacent low temperature spaces; the communication is controlled by a valve operating in phase with the phase changes of the double-acting pistons so that only one pair of low temperature spaces are in communication at any one time. The latter communication operates to displace the independent pumping mechanisms employed by the prior art. The apparatus herein allows the integrated compression spaces to increase the pressure of the working fluid system in series.

7 Claims, 2 Drawing Figures

HYDROGEN COMPRESSION SYSTEM FOR STIRLING ENGINE POWER CONTROL

BACKGROUND OF THE INVENTION

Known control methods for controlling the power of a regenerative type Stirling engine do so by changing the mean pressure prevailing in the working chambers of the engine, such engine typically having a hot chamber and a cold chamber per cylinder, these being separated from one another and adapted to be alternately reduced and enlarged in volume by a piston movable in the cylinder. The hot chamber is connected to the cold chamber within the same engine cylinder or to a cold chamber in another cylinder (operating in a phase-displacement manner) by way of a flow path having a regenerator and cooler therein.

To control power, the mean pressure prevailing in the working chambers is so modified that a high pressure is present in the chambers at a high engine torque demand and a low pressure at a low torque demand. These pressure levels, as well as varying intermediate levels, are achieved by means of a compressor driven by the engine and which is effective to pump the working medium into a reservoir. In the case of a power reduction, the reservoir is maintained at a typically high pressure. A compressor for this task has to meet very high standards. It must have a high pressure ratio, must operate without lubrication of the piston and must be sealed to prevent the escape of hydrogen. These requirements can be met only with difficulty, if they are met at all, and only at great expense. Such compressors may be separate units or may be extensions of the piston extending into close-fitting auxiliary cylinders. The piston extensions may be one or more in number and usually extend from the bottom side of the principal piston. In addition to the increased complexity and cost of utilizing a system which is compressor actuated to transfer gases to or from the working chambers to a reservoir, there is the additional problem that pumping of the working medium out of the working chambers by the small compressors takes place relatively slowly.

Separate small compressors have become a popular means of implementing mean pressure control which in turn provides torque control for the engine. Mean pressure control systems of the prior art have emphasized the need for equalizing the mean pressures in the different working chambers, separated by double acting pistons. However, such prior art systems employ injection or ejection of high pressure from one working chamber at a time which creates a temporary inequilibrium lasting for three or four cycles of the engine until mean pressures stabilize again. What is needed is a mean pressure control system which eliminates independent compressors and yet provides a temporary inequilibrium in mean pressures during a torque demand change commensurate with the inequilibrium now experienced by prior art systems.

SUMMARY OF THE INVENTION

The primary object of this invention is to improve the efficiency and control of a regenerative type Stirling engine by eliminating the necessity for separate and distinct compressor mechanisms capable of transferring working fluid from the working chambers to a reservoir.

Another object of this invention is to rearrange the closed working fluid system of a regenerative type Stirling engine so that greater weight savings and cost savings can be realized while retaining or improving reliability of the system.

Yet another object of this invention is to provide a regenerative type Stirling engine having a control for the closed working fluid system which achieves greater responsiveness than control systems of the prior art.

Features pursuant to the above objects comprise:

a. the use of structural means connecting the low temperature chambers, operating as compression spaces, in series so that the pressure of the working fluid of said system may be raised in stages by the phased operation of the engine pistons without the need for an independent compressor mechanism;

b. the use of structure dividing the pressure reservoir for the working fluid into two parts, one part being maintained at a high predetermined pressure range and the other being maintained at a relatively low operating pressure range, and the use of a shuttle valve selectively communicating the working fluid circuit with one or the other of said reservoirs depending upon the mean pressure within said working circuit whereby the pressure ratio to be overcome by the internal action of said engine is reduced; and c. arrangement of the shuttle valve so that the pressure from the reservoir having the highest predetermined pressure is applied against one end of said valve to bias it in one direction and the force of a mechanical biasing spring is applied against the other end of said shuttle valve, the positioning of said shuttle valve being determined by the mean pressure within said working circuit applied to the end of said shuttle valve affected by said biasing spring.

DETAILED DESCRIPTION

Figures 1, 2:
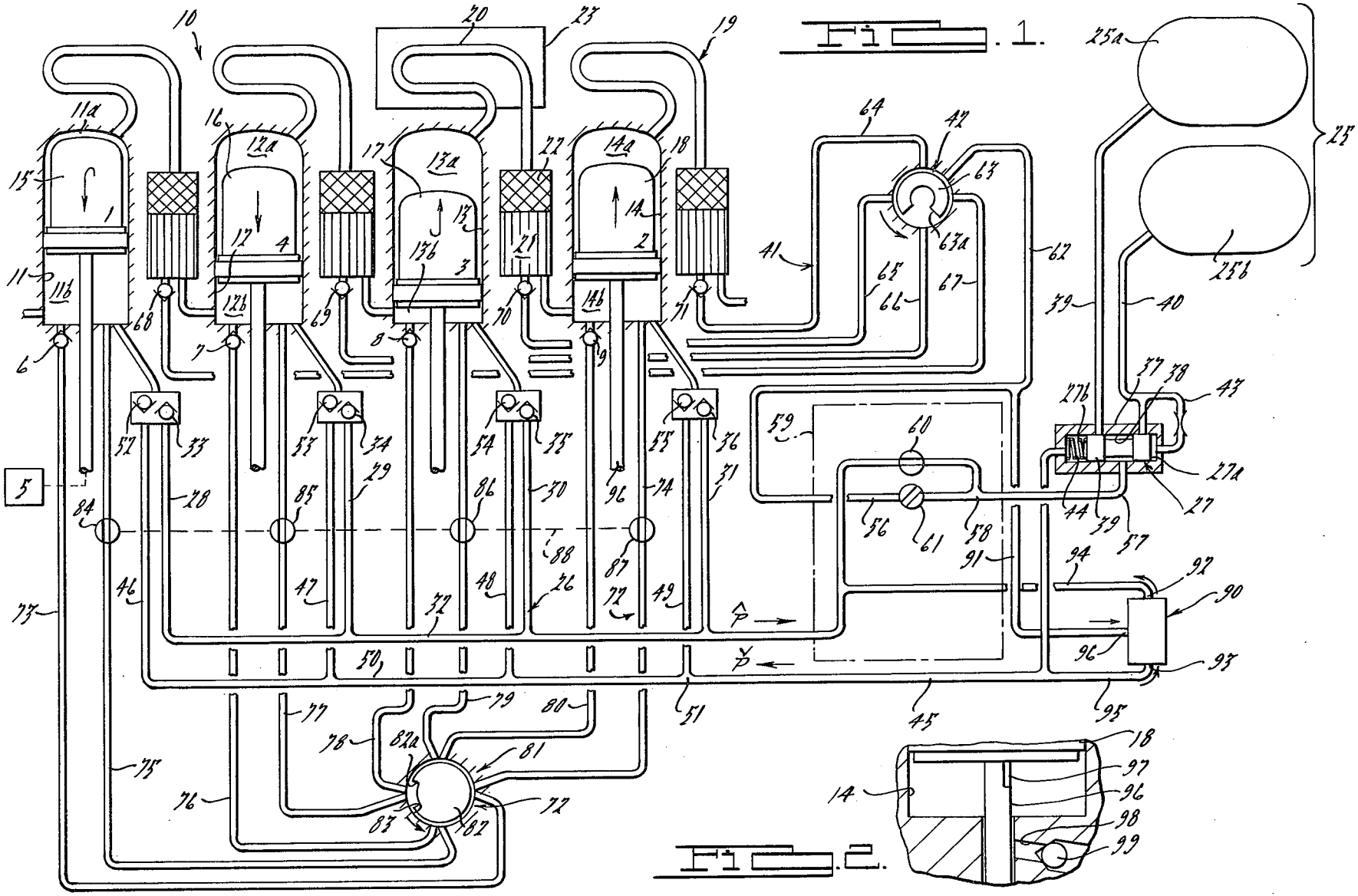
FIG. 1 is a schematic layout of substantially the entire working fluid system of a regenerative Stirling engine embodying the principles of this invention.
FIG. 2 is an enlarged sectional view of a portion of piston and cylinder showing an alternative mode for valve 81.

The invention herein is particularly adaptable to a double-acting Stirling cycle hot gas engine of a kind having a plurality of engine cylinders, each receiving a reciprocating piston therein dividing the engine cylinder into an upper chamber containing gas at a high temperature level and a lower chamber containing gas at a low temperature level. Each of the pistons have integrally connected thereto one or more pumping pistons, which during operation of the engine, reciprocate in an axial direction. According to the prior art of Stirling double-acting piston engines, these pumping pistons extend into an adjacent pumping cylinder provided with two check valves to control gas conduits, one gas conduit leading from the lower chamber of the respective engine cylinder to the pump cylinder, and the other gas conduit operating to assist in the alleviation of gases from the pump cylinder. The pumping pistons, working in the pumping cylinder, together with the appertaining conduits and valves, constitute an arrangement whereby it is possible to vary the quantity of working gas employed in the engine in order to vary the power output of the engine.

In an engine of the type described, it is common to connect the conduit leading from the pumping cylinder to a gas storage tank (reservoir) and to include a stop valve in said conduit to stop the gas flow as soon as a predetermined pressure is reached in the tank. Each pumping piston will be operating on an enclosed volume of gas behaving as a gas spring. Several disadvantages result from such an arrangement, among which include the drawback that the piston rings, working in the pumping cylinder, will be exposed to severe stresses whenever the engine is operating, even during periods when the pumping pistons are not pumping fluid to the tank. In addition, the cost and weight related to the use of such pumping cylinders and pumping pistons, are undesirable when making an automotive application of such engine.

Turning now to FIG. 1, the closed working fluid system 10 of a regenerative Stirling engine comprises a plurality of cylinders 11, 12, 13 and 14, each divided respectively by reciprocating pistons 15, 16, 17 and 18 into two chambers, spaces or volumes (see 11*a*, 11*b*, 12*a*, 12*b*, 13*a*, 13*b*, 14*a* and 14*b*). Chambers 11*a*, 12*a*, 13*a* and 14*a* may be considered a hot or high temperature chamber for purposes of expansion and the others 11*a*, 12*b*, 13*b* and 14*b* may be considered a cold or low temperature chamber for purposes of compression. Each of the cold chambers are connected by a first means 19 to an adjacent hot chamber in progressive series. The means 19 includes for each pair of hot and cold chambers a conduit 20, a cooling mechanism 21 for extracting heat from the closed working gas and a regenerator 22 for storing heat units of the gas passing therethrough or for releasing heat units upon fluid movement in the reversed direction. The fluid in the closed working circuit may preferably be hydrogen maintained at a relatively high mean pressure to present excellent thermal conductivity. The fluid in conduits 20 is heated by an external heating circuit 23 surrounding a substantial portion of each of said conduits 20, promoting heat transfer to the gases therein and elevating the gas temperature to about 1300° F. Assembly 5 is a means for deriving work energy from the system 10, such as mechanical swash plate assembly.

Due to the separation of each pair of hot and cold chambers by a piston, both ends of the dividing piston act as a work surface, hence the term double-acting piston arrangement. The pistons are all connected to a common mechanical driven means 24, which assure that the pistons will be operating 90° out of phase with the next most leading or trailing piston.

In automotive applications, the shaft torque of the engine must be varied over a large range during normal operation of the vehicle. Torque control or power control is accomplished by changing the mean cycle pressure of the working gas within the variable volume chambers 11*a*, 11*b*, 12*a*, 12*b*, 13*a*, 13*b*, 14*a* and 14*b*. Such pressure variations are usually from a pressure minimum of 25 atmospheres to a pressure maximum of over 200 atmospheres. This invention proposes to connect the compression spaces (cold spaces 11*b*, 12*b*, 13*b* and 14*b* of adjacent cylinders in a manner which will allow engine compression strokes by way of said pistons 15, 16, 17 and 18 to work consecutively to produce a sufficient pressure head to fill a gas reservoir means 25 used in the pressure regulation of the closed working system 10. The reservoir means 25 contains two separate reservoirs 25*a* and 25*b* for additional novel purposes herein; a novel valve 27 responsive to high and low ranges of the mean pressure in the working system 10 serves to regulate the pressures in the two reservoirs.

When the closed working system 10 is substantially filled with high pressure gas, leaving the reservoirs substantially depleted and at their low end of a predetermined pressure range, such as may occur at full throttle for the engine, any change of pressure from this condition must involve transfer of gas from the cylinders to the reservoir. To this end, a first means 26 provides a one-way fluid communication to the reservoirs 25. Means 26 comprises conduits 28, 29, 30 and 31 respectively leading from each of the cold chambers and which commonly connect to passage 32; to insure one-way communication from the cold chambers, check-valves 33, 34, 35 and 36 are interposed respectively in conduits 28–31. The passage 32 will be referred to as the Pmax. line, always containing the maximum pressure in the cold chambers except during a transient change of mean pressure during deceleration or acceleration of the vehicle. Pmax. is assured by the orientation of said check valves 33–36 permitting flow only to the reservoirs. Similarly, passage 50 acts as a P min. or minimum chamber pressure line, always containing the minimum pressure in the cold chambers as assured by the opposite orientation of one-way valves 52–55 permitting flow only to the cold chambers from the reservoirs by way of a passage or conduit path including 39 or 40, 57, 56, 91 and 95.

Valve 27 directs fluid in passage 32 to one of the two reservoirs 25*a* or 25*b*. Valve 27 comprises a valve housing 37 defining a cylindrical bore 38 in which is slidable a closely fitting spool valve 39. Passage 32 by way of passage 57 connects with a center position of the bore 38 and passages 39 and 40 connect with off-center positions of said bore. Passage 39 connects also with the low pressure range reservoir 25*a* and passage 40 connects with high pressure range reservoir 25*b*.

One end 27*a* of spool valve 27 receives a high reservoir pressure force from passage 40 via conduit 43 causing the spool to be biased to the left; the other end 27*a* is biased to the right by force of a spring 44 and the force of the minimum pressure in the working cylinders via passage 50 and conduit 45. The minimum pressure results from the one-way communication to the cold chambers provided by conduits 46, 47, 48 and 49 commonly connected to passage 50 which in turn connects at 51 to said conduit 45; the one-way check valves 52, 53, 54 and 55 insure fluid flow only into said cylinders causing the pressure in passage 50 to be at about the minimum cycle pressure for the system except during transient changes in mean pressure in the cold chambers.

A second means 41 is employed to direct fluid from the reservoirs and inject said fluid into one cylinder at any one moment by a timed valve 42 for purposes of increasing the mean working pressure in response to a demand for more engine torque. Means 41 comprises conduit 56 which connects also to passage 57 at 58. A gate valve assembly 59, responsive to a change in engine torque demand, directs fluid to flow through first means 26 or through second means 41. The assembly has a gate valve 60 interrupting passage 32 and a gate valve 61 interrupting conduit 56. Fluid flow permitted through conduit 56 is carried by passage 62 to the timed valve 42. Timing of the injection of reservoir fluid into any one cylinder is important to reduce or eliminate negative work on the added fluid by the associated piston. To this end the injection is timed to occur at the end of the compression cycle and substantially during the expansion cycle. Obviously this requires a control to orchestrate this type of injection among the several cylinders each operating at a different phase from the other.

The timing of injection of reservoir pressure into only one cylinder at any one moment is modified in one respect. It has been found that the disadvantage of negative work, which would occur if all cold chambers were injected simultaneously is outweighed by the disadvantage of slow engine response when the mean pressure reaches a certain level. Thus, a switch-over valve assembly 90 is employed to permit injection simultaneously into all of the cold chambers by a path through conduits 39 or 40, 57, 56, 91, 95, 45, 50 and each of 46, 47, 48 and 49 when the mean pressure is sensed to be above a middle level. During the initial stage of acceleration, the mean pressure will be below the middle level and valve 90 will be in the other position blocking communication to 95, but permitting communication to 94 which in turn is blocked by one-way valves 33–36 from entering the cold chambers.

Timed valve 42 has a valve element 63 which causes to rotate at a speed synchronous with phase changes in the cylinders 11–14, whereby fluid communication between passage 62 and one of the passages 64, 65, 66 or 67 is permitted through opening **63*a* at the precise moment when injection of higher pressure fluid is best to effect a desired torque change. One-way check valves 68, 69, 70 and 71** insure injection of fluid into the cylinders.

A third means 72 interconnects the cold spaces in a most important manner. Means 72 comprises pairs of conduits 73–74, 75–76, 77–78, and 79–80, each pair of conduits connect separately to the interior cylinder 83 of a timed valve 81. The timed valve has a rotor valve member 82 which rotates in synchronous phase with the phase changes of the cylinders 11–14 so that a communication through valve opening **82*a* and through any one pair of passages is permitted at the precise time when one of the cold chambers associated with the pair of passages is undergoing compression or has completed compression. The latter is preferable to provide the greatest opportunity for a particular cold space to transfer fluid to the reservoir means before a communication is established to allow transfer to the next trailing cold chamber. Complete cut-off of the communication between cold chambers can be established by the sizing of the opening 82*a*; however, as a practical matter, the check valves 6, 7, 8 and 9** will function to limit the communication.

Thus, the cold spaces are connected in sequential series so that the pistons 15–18 may perform one or more phase pumping functions to increase pressure beyond the maximum cycle pressure. The increased pressure is permitted to flow back to the reservoirs for restoring pressure therein. The third means 72 is made to operate in conjunction with the opening of passage 32 by actuating gate valves 84, 85, 86 and 87 and gate valve 60 through a linkage 88 to open and close simultaneously.

When the demand for engine shaft torque is reduced, indicated by a reduced throttle opening or position, the mean cycle pressure (P mean) must be reduced by transferring fluid (hydrogen) from the engine to the reservoir means. Gate valve 60 is opened and gate valve 61 is closed. During a portion of a cycle at some operating condition where the maximum cycle pressure (P max.) is greater than the reservoir pressure ($P_r$), fluid will flow through one of the check valves 33–36 and gate valve 60, directly to the reservoirs 25. When P max. is less than $P_r$, fluid cannot flow from the reservoirs to the cold chambers through passage 32 (P max.) because of the check valves 33–36; fluid will flow into the adjacent trailing compression space during or at the end of the associated compression stroke of the cold space from which fluid is flowing. The latter is permitted for each cold space in series timing as controlled by valve 81. Such transferred fluid will then be further compressed to an even higher pressure head and allowed to flow to the reservoir system when P max. is instantaneously greater than $P_r$, in any subsequent cold chamber, or again to the next adjacent trailing compression space.

The timed valve 81 may be constructed as shown with a valve seat arranged as circular interior cylinder having openings equi-circumferentially arranged thereabout. Each set of adjacent openings are fluidly connected to adjacent compression spaces, said sets being arranged in an order according to the series connections of cylinders. The central rotor valve rotates within the cylinder at a speed so that a valve or opening **82*a* (having a dimension effective to span two adjacent passage openings) will connect a set of openings substantially during the compression phase of one of the associated cold spaces. Actuation of rotor valve 82** can be by mechanical drive train or by hydraulic means pulsing said member in phase with the pressure variations of the cold spaces.

A simpler mode of making the valve 81 may be use of a groove 97 in the upper end of each piston rod 96 (see FIG. 2). When the piston rod substantially reaches bottom dead center at or near the completion of the compression stroke, a communication through groove 97 and passage 98 is established. Passage 98 (and one-way valve 99) act as any of the passages 73, 76, 78, 80 with a respective check-valve 6, 7, 8 or 9. Passage 98 leads to the next trailing cold chamber. Phase timing is achieved by the action of the piston rod.

The reservoir system 25 stores all of the hydrogen gas or fluid required to raise the engine mean cycle pressure from the minimum level of about 25 atmospheres to a maximum in excess of 200 atmospheres. The pressure will range from slightly above P min. (that pressure which exists in an expanded cold space) to the highest engine operating pressure, depending upon the reservoir system volume. With a simple reservoir system according to the prior art employing a single bottle, the $H_2$ would, in the most difficult situation, have to be compressed 200 atmospheres resulting in the imposition of extremely high forces on anyone pumping piston. To overcome this, a dual reservoir system is employed. This reservoir system has a shuttle or spool valve assembly 27 which distributes pressure to one of two reservoirs **25*a* and 25*b*. Reservoir 25*b* is utilized for the high pressure range of the engine when the engine mean cycle pressure is high. Reservoir 25*a* is used for the low pressure range, when the mean cycle pressure is low. This reduces the maximum operating pressure ratio (imposed on the integral series pumping system) during compression and also reduces the work of compression. The balance of such forces on opposite ends of the spool valve determines the position of the spool valve to communicate passage 57 with either passage 39 for reservoir 25*a* or passage 40 for reservoir 25*b*.**

We claim:

1. For use in a regenerative Stirling engine employing a plurality of double-acting pistons, each operating within a cylinder to define therein hot and cold chambers on opposed sides of each of said pistons, an apparatus for controlling the power of said engine, comprising:

a. reservoir means regulated to maintain a predetermined pressure therein and being connected to said closed pressurized gas system, b. first means providing a reversible fluid communication for each one of said cold chambers and one of the next most adjacent hot chambers in series, c. second means providing a one-way fluid communication between each of said cold chambers and said reservoir means, said communication permitting pressurized fluid flow from said cold chambers to said reservoir during steady state or reduced engine torque demand and when the pressure in any one of said cold chambers exceeds the pressure in said reservoir means, d. third means providing a one-way fluid communication between said reservoir means and said cold chambers, said communication permitting pressurized fluid flow sequentially from said reservoir means to each one of said cold chambers during increased engine torque demand and when the pressure in said reservoir means exceeds the pressure in any one of said cold chambers, and e. fourth means providing a one-way fluid communication between adjacent cold chambers, said communication being timed in phase relation to the operation of said piston so that the communication is permitted when the egressing cold chamber is undergoing or has completed compression and the ingressing cold chamber is preparing to undergo compression whereby fluid in said cold chambers is subjected to a staged pumping effect for increasing the mean pressure therein.

2. For use in a regenerative Stirling engine employing an assembly having a plurality of double-acting pistons, each operating within a cylinder to define therein hot and cold chambers on opposed sides of each of said pistons, an apparatus for controlling the power of said engine, comprising:

a. reservoir means regulated to maintain a predetermined pressure therein and being connected to said closed pressurized gas system, b. first means providing a one-way fluid communication between each of said cold chambers and said reservoir means, said communication permitting pressurized fluid flow from said cold chambers to said reservoir when the pressure in said cold chambers exceeds the pressure in said reservoir, c. second means providing a one-way fluid communication between said cold chambers in series, the direction of said one-way communication being from one cold chamber undergoing compression to the next cold chamber lagging in compression, d. a power control responsive to the torque demand of said engine to open said first means communicating said cold chambers with said reservoir for reducing the pressure in said system and to open said second means to permit said fluid pressure to flow between cold chambers in series in accordance with the thermodynamic cycling of said piston and cylinder assembly, thus employing said pistons as a stepped pumping system for restoring an elevated pressure in said reservoir means.

3. The apparatus as in claim 1, in which said reservoir means is comprised of two independent reservoir chambers, each chamber being independently controlled to separate pressure levels, one being regulated to a relatively high pressure level and the other regulated to a relatively low pressure, said reservoir means further including a directional valve effective to selectively connect one of said reservoirs with the closed fluid system in response to the engine torque demand requiring either an associated low pressure or an associated high pressure in said system, whereby the work required of said double-acting pistons for said staged pumping effect is reduced.

4. The apparatus as in claim 2, in which said reservoir means is comprised of two independent reservoir chambers, each chamber being independently controlled to separate pressure levels, one being regulated to a relatively high pressure level and the other regulated to a relatively low pressure, said reservoir means further including a directional valve effective to selectively connect one of said reservoirs with the closed fluid system in response to the engine torque demand requiring either an associated low pressure or an associated high pressure in said system, whereby the work required of said double-acting pistons for said staged pumping effect is reduced.

5. The apparatus as in claim 1, in which said reservoir means particularly comprises a pair of reservoir chambers, and a shuttle valve to alternately permit communication between one or the other of said reservoirs with the closed fluid system, one of said reservoir chambers being regulated to a high pressure level equal to or in excess of 150 atmospheres and having a passage communicating said reservoir with one end of said shuttle valve to bias said valve in one direction, the other of said reservoir chambers being regulated to a relatively low pressure condition in the range of 70–150 atmospheres, resilient means biasing said valve in an opposite direction, and means communicating fluid mean pressure within said system with said valve to add to the force of said resilient means operating in said opposite direction, said shuttle valve being moved to one position or another by the balance of forces imposed on said valve thereby providing communication with one or the other of said reservoirs.

6. The apparatus as in claim 2, in which said power control means has a gating valve comprised of an extension of said piston having one or more grooves defined thereon to act as a valve, said piston extension being movable within a close fitting cylindrical space defined by a wall acting as a valve housing, said communicating means between said cold chambers being connected to a predetermined location of the wall of said cylindrical space whereby upon movement of said piston, said groove is caused to traverse said communicating means permitting a timed completion of fluid communication in response to a predetermined compression position of said piston.

7. A regenerative Stirling cycle engine system, comprising:

a. means defining a hot gas volume containing a gas having a low or high density and respectively a high or low thermal conductivity, b. means defining a low temperature gas volume in communication with said hot gas volume, each low temperature gas volume being associated with one hot gas volume to define a pair of cycling volumes, c. piston means associated with each pair of cycling volumes and being in communication with at least the low temperature gas volume for varying the low temperature volume in timed relation to the variations in the hot gas volume, d. thermal regenerator and cooling means intercoupling the hot gas volume and the low temperature gas volume of each pair of cycling volumes to provide reversible thermodynamic gas flow therebetween during changes of volume, e. means coupled to said means defining a hot gas volume for releasing thermal energy thereinto, f. means coupled to said piston means for deriving working energy from the system, g. means providing a one-way fluid connection between adjacent low temperature volumes in series, h. means fluidly connecting said pair of volumes, and i. control means selectively permitting fluid communication through any two selected and adjacent low temperature volumes of means (g), one of said low temperature volumes undergoing compression or is at a compressed condition, while allowing continuous one-way fluid communication from said selected and adjacent low temperature volumes to a reservoir so that if the instantaneous pressure of said reservoir is greater than said communicated low temperature volume, one low temperature space will pump fluid into the other lower temperature space to be raised in pressure therein.

* * * * *